US010800190B2

(12) United States Patent
Moehringer

(10) Patent No.: US 10,800,190 B2
(45) Date of Patent: Oct. 13, 2020

(54) BELT CONVEYOR FOR PRINTING SHEETS

(71) Applicant: HEIDELBERGER DRUCKMASCHINEN AG, Heidelberg (DE)

(72) Inventor: Markus Moehringer, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/508,775

(22) Filed: Jul. 11, 2019

(65) Prior Publication Data

US 2020/0094585 A1 Mar. 26, 2020

(30) Foreign Application Priority Data

Sep. 20, 2018 (DE) ..... 10 2018 216 029

(51) Int. Cl.
*B41J 11/00* (2006.01)

(52) U.S. Cl.
CPC ..... *B41J 11/007* (2013.01)

(58) Field of Classification Search
None
See application file for complete search history.

(56) References Cited

U.S. PATENT DOCUMENTS 4,640,775 A * 2/1987 Pietzsch ..... B01D 33/503 210/387
2005/0190250 A1* 9/2005 Howarth ..... B41J 11/04 347/104

FOREIGN PATENT DOCUMENTS

| | | | |
|---|---|---|---|
| DE | 4219285 | A1 | 1/1993 |
| DE | 102014224972 | A1 | 6/2016 |
| EP | 3067211 | A1 | 9/2016 |
| WO | 2018087119 | A1 | 5/2018 |

* cited by examiner

*Primary Examiner* — Alejandro Valencia
(74) *Attorney, Agent, or Firm* — Laurence A. Greenberg; Werner H. Stemer; Ralph E. Locher

(57) ABSTRACT

A belt conveyor for printing sheets includes an outer belt on which the printing sheets rest during transport. The belt conveyor also includes an inner belt. A chain is disposed between the inner belt and the outer belt. The inner belt drives the chain and the chain drives the outer belt.

11 Claims, 4 Drawing Sheets

BELT CONVEYOR FOR PRINTING SHEETS

CROSS-REFERENCE TO RELATED APPLICATION

This application claims the priority, under 35 U.S.C. § 119, of German Patent Application DE 10 2018 216 029.5, filed Sep. 20, 2018; the prior application is herewith incorporated by reference in its entirety.

BACKGROUND OF THE INVENTION

Field of the Invention

The present invention relates to a belt conveyor for printing sheets, which includes a revolving belt on which the printing sheets rest during transport.

Such belt conveyors are used in printing machines, for instance to transport sheets of paper or cardboard past inkjet print heads during a printing operation.

German Patent Application DE 10 2014 224 972 A1 discloses a belt conveyor in which measures have been taken to reduce friction underneath the suction belt.

European Patent EP 3 067 211 B1 discloses a printing machine in which sheets are transported on trays. The trays are driven by timing belts that have entrainment elements for the trays. The teeth of the timing belts have an arrow-like, round, or skewed shape to reduce the polygon effect that causes speed fluctuation and vibration in the timing belt.

SUMMARY OF THE INVENTION

It is accordingly an object of the invention to provide an alternative belt conveyor including a belt on which printing sheets rest during transport, which overcomes the hereinafore-mentioned disadvantages of the heretofore-known belt conveyors of this general type and which works at a reduced vibration and shock rate.

With the foregoing and other objects in view there is provided, in accordance with the invention, a belt conveyor for printing sheets, the belt conveyor comprises a revolving outer belt on which the printing sheets rest during transport, an inner belt and a chain disposed between the inner belt and the outer belt, in which the inner belt drives the chain and the chain drives the outer belt.

Various further developments are possible:

- The chain may hold on to the inner belt in a pneumatic way.
- The chain may hold on to the outer belt in a pneumatic way.
- The connection between the chain and the inner and outer belts may be a frictional connection.
- The outer belt may run on rolls that have a smaller diameter than the rolls the inner belt runs on.
- Different vacuum generators may be provided to hold the chain against the inner belt by suction and to hold the printing sheets on the outer belt by suction.
- A first read head and a second read head may be provided to detect the chain. The read heads may be disposed one behind the other on the chain at a specified read head distance.
- The chain may have gauges that are detected by the first and second read heads.
- The first read head and the second read head may be active in an alternating way, with one read head always being active when a gap in the chain is located in the target region of the other read head.

- Profile elements may be components of the chain or fixed to the chain, with each profile body including a vacuum chamber.
- The belt conveyor may be a component of a printing machine.
- One station of the printing machine may be at least one print head that may be oriented towards the outer belt to print on the sheets located thereon.

Other features which are considered as characteristic for the invention are set forth in the appended claims.

Although the invention is illustrated and described herein as embodied in a belt conveyor for printing sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
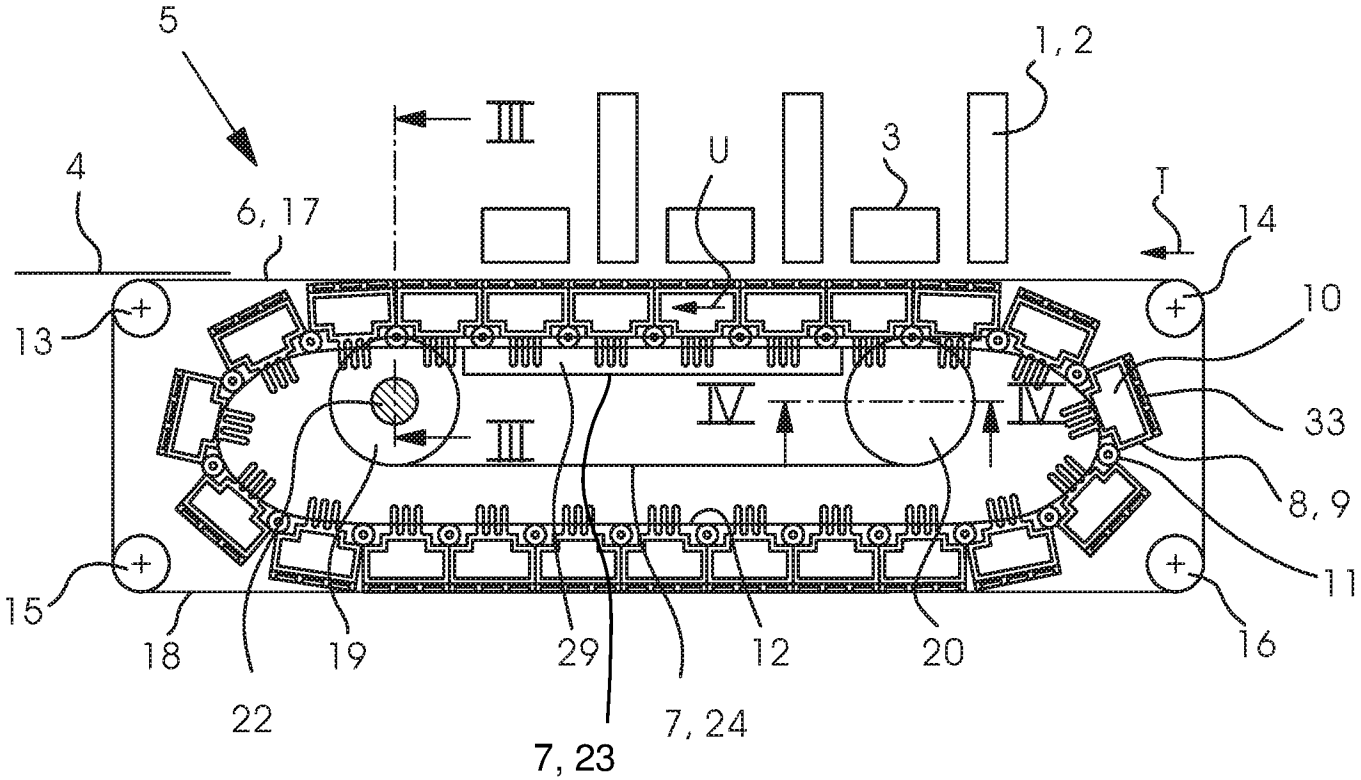
FIG. 1 is a diagrammatic, overall, side-elevational view of a printing machine with a belt conveyor.

Referring now to the figures of the drawings in detail and first, particularly, to FIG. 1 thereof, there is seen a printing machine 1 which includes stations 2, 3 for treating printing sheets 4 and a belt conveyor 5 that transports the printing sheets 4 past the stations 2, 3 in a direction of travel T in the process. The stations 2, 3 may include one or more print heads 2, for instance for inkjet printing, and one or more driers 3 for drying the print, or both. The belt conveyor 5 includes an endless outer belt 6 and, on every machine side, an endless inner belt 7. The two inner belts 7 are jointly shown in FIG. 2, which also illustrates the symmetry of the two machine sides. Thus, it is sufficient for the following description to be limited to one machine side. A chain 8 is provided between the outer belt 6 and the inner belt 7. The chain 8 has profile bodies 9. The profile bodies 9 may be chain links or may be connected to one another by chain links, for instance idler rollers 11. The outer belt 6 is a vacuum belt and has a perforation for holding the sheets 4 by suction as they rest on the outer belt 6 during transport. The outer belt 6 may be made of a plastic material and the inner belt 7 may be made of steel. The profile bodies 9 are bar-shaped hallow profiles with a vacuum chamber 10 on the inside. They extend over the width of the maximum processable format of the printing sheet 4 in the longitudinal direction. The idler rollers 11, which are links of the chain 8 or fixed thereto, run on an annular guide rail 12, defining a closed path of the profile bodies 9. The chain 8 revolves in a direction of revolution U. The outer belt 6 runs over guide rollers 13, 14, between which it forms a transport strand 17, and over guide rollers 15, 16, between which there is a return strand 18 of the outer belt 6. The printing sheets 4 rest on the transport strand 17 while they are being printed on and dried, if applicable.

The number of guide rollers 13 to 16 that the outer belt 6 wraps around is at least three, preferably four, allowing the guide rollers 13, 14 between which the transport strand 17 is located to be of small dimensions. A smaller radius of these guide rollers 13, 14—smaller than a radius of rollers 19, 20 of the inner belt 7 and smaller than a deflection radius of the chain 8—is advantageous in view of combining the belt conveyor 5 with an upstream or downstream belt conveyor. The small roller size allows the gap between the two belt conveyors to be kept small, which in turn is advantageous in view of transferring the printing sheets 4 from one belt conveyor to another. The inner belt 7 wraps around a drive roller 19 and a deflection roller 20. A shaft 22 connects a motor 21 and the drive roller 19 in order to drive the drive roller, thus driving the inner belt 7. The drive roller 19 and the inner belt 7 are connected by a frictional connection. Thus, the drive roller 19 may be referred to as a friction wheel. The inner belt 7 has a load strand 23, which is pulled by the drive roller 19, as well as an empty or non-driving strand 24. The inner belt 7, the chain 8 and the outer belt 6 run in synchronism with one another in a counter-clockwise direction in terms of the drawing.

Every profile body 9 has a suction opening 25 at the bottom on an inner side, in terms of the path of revolution. The profile body 9 adheres to the load strand 23 by suction through the suction opening 25. Due to the fact that the profile body 9 pneumatically adheres to the inner belt 7, the frictional connection between the inner belt 7 and the profile body 9 is increased and virtually becomes static friction. The inner belt 7 may thus drive the chain 8 without any undesired slip between the two. The suction opening 25 forms a groove system in the form of a furcation or branching 26 to be able to provide a large suction area to hold the inner belt 7, thus ensuring a reliable adhesion between the profile body 9 and the inner belt 7. A U-shaped connecting channel 27 connects the suction opening 25 to a connector opening 28, which is likewise disposed in the bottom of the profile body 9. The two openings 25, 28 are ends of the connecting channel 27 and are horizontally offset relative to one another in a direction that is transverse—i.e. orthogonal or oblique—relative to the direction of transport T.

In order to apply a vacuum to the suction opening 25 whenever the profile body 9 passes the load strand 23, a temporary air-guiding connection is established between the connector opening 28 and a vacuum rail 29 along which the profile body 9 moves. The vacuum rail 29 is parallel to the direction of transport T and has a longitudinal groove 30, which is connected to a first vacuum generator 31 symbolically indicated by an arrow. The vacuum rail 29 is stationary and is fixed, for instance, to a frame 32 of the belt conveyor 5. During the period in which the connector opening 28 is located opposite the longitudinal groove 30, the evacuated suction air flows from the connector opening 28 into the longitudinal groove 30, through which it is aspirated by the first vacuum generator 31.

Every profile body 9 has one or more cross grooves 33 on its top side, which is its outer side in terms of its path of revolution. The cross grooves 33 cause the profile body 9 to adhere to the transport strand 17 by suction and at the same time cause the printing sheets 4 to be held on the transport strand 17 by vacuum through the perforation of the outer belt 6. The longitudinal extension of the cross grooves 33 is transverse to the direction of transport T. The fact that the profile body 9 pneumatically adheres to the outer belt 6 causes the frictional connection between the profile body 9 and the outer belt 6 to be increased, virtually until it is static friction. The chain 8 may thus drive the outer belt 6 without undesired slip between the two.

Every cross groove 33 is connected to the vacuum chamber 10 in the interior of the profile body through a through hole and is thus connected to a second vacuum generator through the vacuum chamber 10. Thus, there are two separate vacuum generators that are controllable independently of one another, the first vacuum generator 31 which is responsible for the pneumatic connection between the inner belt 7 and the chain 8 and the second vacuum generator which is responsible for the pneumatic connection between the chain 8 and the outer belt 6 and for holding the printing sheets 4 by suction. This is advantageous for processing printing sheets 4 that have different properties from print job to print job, for instance different thicknesses or different permeability to air, which are characteristics that require the power of the suction air for holding the sheets to vary. A corresponding adjustment of the power of the second vacuum generator may be made independently of the first vacuum generator 31, i.e. without affecting the pneumatic connection between the inner belt 7 and the chain 8. For instance, a reduction of the suction power of the second vacuum generator to process printing sheets 4 that are hardly permeable to air cannot cause any undesired side effects in the form of slip between the inner belt 7 and the chain 8.

Figure 2:
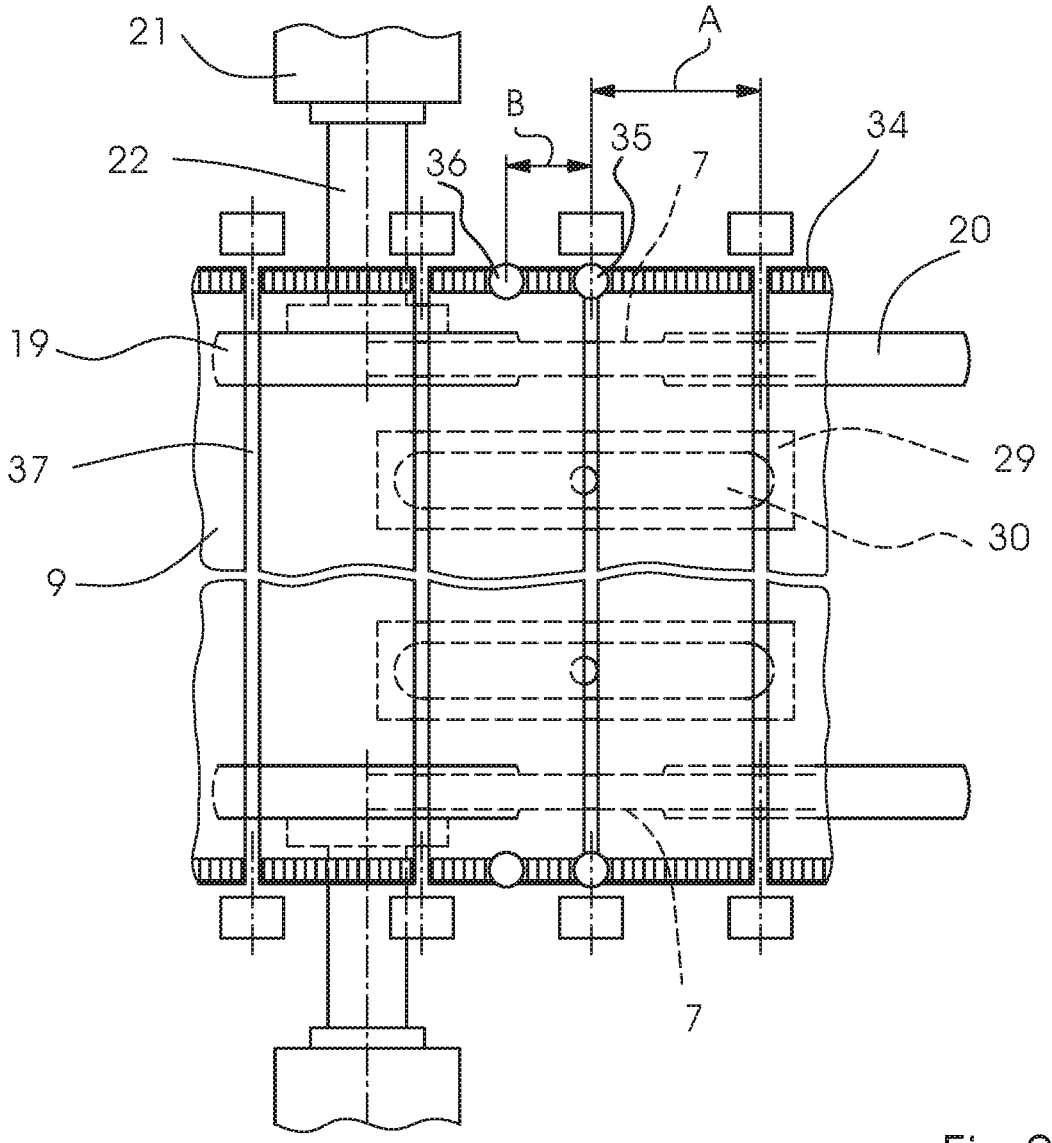
FIG. 2 is an enlarged, fragmentary, top-plan view of the belt conveyor.
Figure 3:
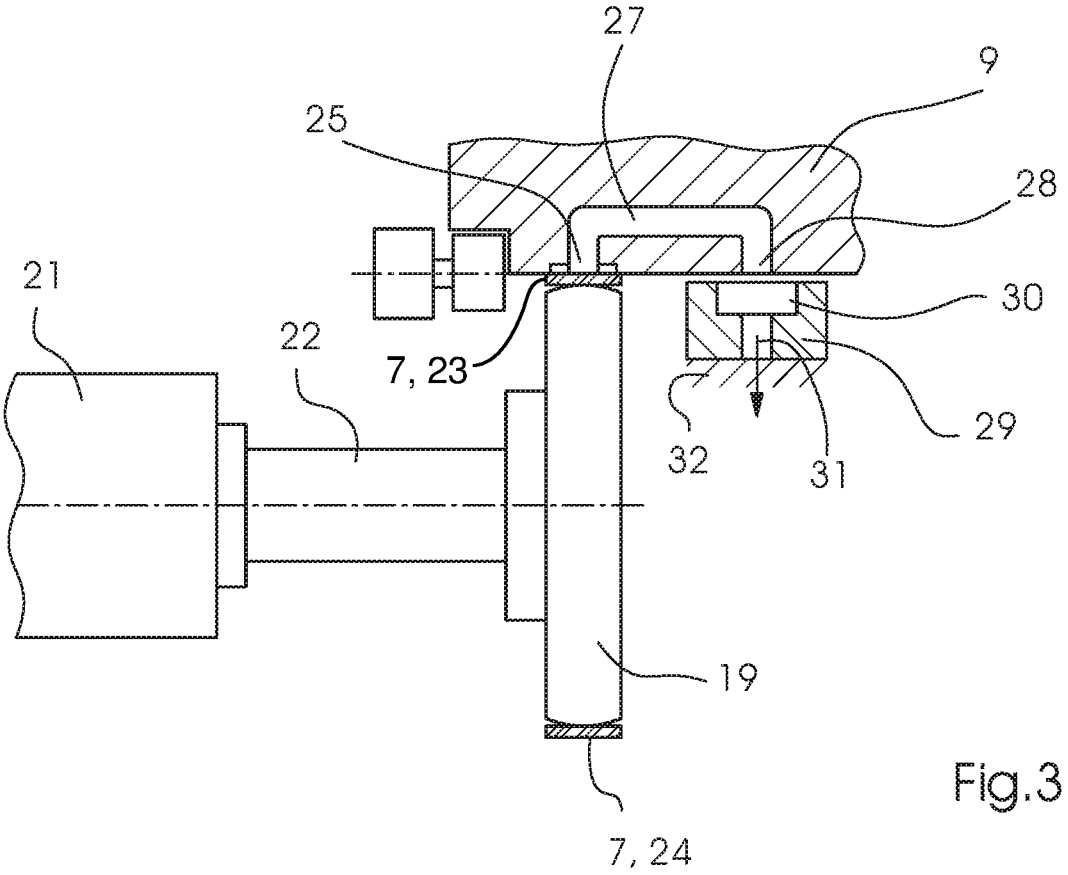
FIG. 3 is a further enlarged, fragmentary, sectional view taken along the line III-III of FIG. 1 in the direction of the arrows.
Figure 4:
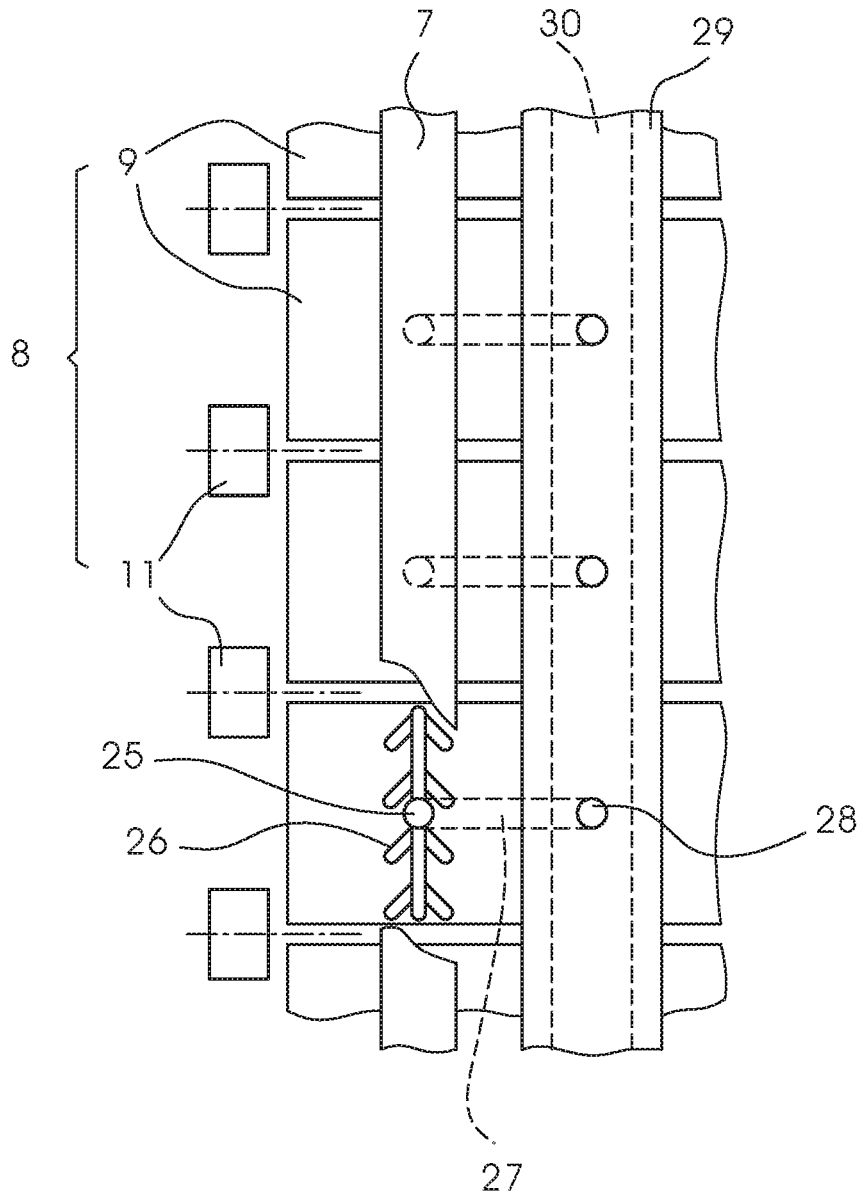
FIG. 4 is a sectional view taken along the line IV-IV of FIG. 1 in the direction of the arrows.

For reasons of clarity, the outer belt 6 and the cross grooves 33 are not shown in FIG. 2. FIG. 2 shows that every profile body 9 has a mark or gauge 34 that are detectable by a first sensor or read head 35 and by a second sensor or read head 36. The gauge 34 is disposed on a rim of the profile body 9, i.e. on a rim that is not covered by the outer belt 6, on the outer side of the top thereof in which the cross grooves 33 are also located. The first read head 35 and the second read head 36, which are passed by every profile body 9 with its gauge 34, are stationary and fixed to the frame 32, for example. The chain 8 has gaps 37 between the profile bodies 9 that are spaced apart from one another by a gap distance A. The two read heads 35, 36 are disposed at a head distance or spacing B from one another. The head distance B, like the gap distance A, is to be measured in a direction parallel to the direction of transport T. The head distance B is smaller than the gap distance A to ensure that at least one of the two read heads 35, 36 is disposed opposite the gauge 34 of one of the profile bodies 9 at all times. Every time a gap 37 enters the target region of the first read head 35, the second read head 36 is automatically activated, and every time a gap 37 is located in the target region of the second read head 36, the first read head 35 is in operation. In accordance with a modification that is not shown in the drawings, the head distance B may be greater than the gap distance A, but not an integer multiple of the gap distance A. These dimensions likewise ensure that one of the two read heads 35, 36 is directed towards one of the gauges 34 at all times. There is no time in which a gap 37 is in the target area of the first read head 35 and simultaneously another gap 37 is in the target area of the second read head 36. The read heads 35, 36 are parts of a closed control loop for controlling the speed of the motor 21 and consequently the speed of the outer belt 6 and the transport speed of the printing sheets 4.

An advantage of the belt conveyor 5 shown herein is that it runs virtually without vibration and virtually without any shocks. This is achieved by dispensing with toothed gearing elements in the drive train between the motor 21 and the outer belt 6. Neither the inner belt 7 nor the outer belt 6 is a timing belt. Instead, all driving connections, namely the connection between the drive roller 19 and the inner belt 7, the connection between the inner belt 7 and the chain 8, and the connection between the chain 8 and the outer belt 6, are frictional connections, with the two latter connections that involve the chain 8 being virtually under static friction due to the fact that the chain 8 adheres to the belts 6, 7 by suction. The chain 8 has openings, that is the suction openings 25, to which a vacuum is applied to cause the chain 8 to pneumatically adhere to the inner belt 7, as well as openings, that is the cross grooves 33, to which a vacuum is likewise applied to cause the chain 8 to pneumatically adhere to the outer belt 6. The fact that the sheets are transported virtually without vibration and without any shocks avoids shock stripes that would otherwise be caused by toothings and would be visible in the print.

The following is a summary list of reference numerals and the corresponding structure used in the above description of the invention:

1 printing machine
2, 3 station
4 printing sheet
5 belt conveyor
6 outer belt
7 inner belt
8 chain
9 profile body
10 vacuum chamber
11 idler roller
12 guide rail
13-16 guide roller
17 transport strand
18 return strand
19 drive roller
20 deflection roller
21 motor
22 shaft
23 load strand
24 empty strand
25 suction opening
26 furcation
27 connecting channel
28 connector opening
29 vacuum rail
30 longitudinal groove
31 vacuum generator
32 frame
33 cross groove
34 gauge
35 first read head
36 second read head
37 gap
A gap distance
B head distance
T direction of transport
U direction of revolution

The invention claimed is:

1. A belt conveyor for printing sheets, the belt conveyor comprising:
- a revolving outer belt on which the printing sheets rest during transport;
- an inner belt;
- a chain disposed between said inner belt and said outer belt, said chain being driven by said inner belt and said chain driving said outer belt; and
- said chain pneumatically adhering to said inner belt.

2. The belt conveyor according to claim 1, wherein said chain pneumatically adheres to said outer belt.

3. The belt conveyor according to claim 1, wherein said chain is connected to said inner belt and to said outer belt by frictional connections.

4. The belt conveyor according to claim 1, which further comprises rollers over which said inner belt runs and rollers over which said outer belt runs, said rollers over which said outer belt runs having a smaller diameter than said rollers over which said inner belt runs.

5. The belt conveyor according to claim 1, which further comprises a vacuum generator causing said chain to adhere to said inner belt by suction and a different vacuum generator causing said printing sheets to adhere to said outer belt by suction.

6. The belt conveyor according to claim 1, which further comprises a first read head and a second read head for detecting said chain, said first and second read heads being disposed one behind the other in a direction of revolution of said chain and at a specified read head spacing from one another.

7. The belt conveyor according to claim 6, wherein said chain has gauges being detected by said first read head and said second read head.

8. The belt conveyor according to claim 7, wherein said first read head and said second read head are alternatingly active by causing one of said read heads to always be active when a gap in said chain is in a target region of the other of said read heads.

9. The belt conveyor according to claim 1, which further comprises profile bodies being components of said chain or being fixed to said chain, each of said profile bodies having a respective vacuum chamber.

10. The belt conveyor according to claim 1, wherein the belt conveyor is a component of a printing machine.

11. The belt conveyor according to claim 10, wherein said outer belt is oriented towards at least one inkjet print head as a station of the printing machine for printing on the sheets located on said outer belt.

* * * * *